US007992550B2

(12) United States Patent
Watanuki et al.

(10) Patent No.: US 7,992,550 B2
(45) Date of Patent: Aug. 9, 2011

(54) EXHAUST GAS RECIRCULATION VALVE

(75) Inventors: Haruo Watanuki, Tokyo (JP); Satoru Hasegawa, Tokyo (JP); Naosuke Nojima, Tokyo (JP); Sotsuo Miyoshi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 62 days.

(21) Appl. No.: 12/513,635

(22) PCT Filed: Sep. 14, 2007

(86) PCT No.: PCT/JP2007/067962

§ 371 (c)(1),
(2), (4) Date: May 5, 2009

(87) PCT Pub. No.: WO2008/081622

PCT Pub. Date: Jul. 10, 2008

(65) Prior Publication Data

US 2010/0065027 A1 Mar. 18, 2010

(30) Foreign Application Priority Data

Dec. 28, 2006 (JP) ..... 2006-355792

(51) Int. Cl.
*F02B 47/08* (2006.01)
*F02B 47/00* (2006.01)

(52) U.S. Cl. ..... 123/568.21

(58) Field of Classification Search ..... 123/568.11, 123/568.21, 568.12, 568.29; 701/108; 60/605.1, 60/605.2

See application file for complete search history.

(56) References Cited

U.S. PATENT DOCUMENTS

| | | | | | |
|---|---|---|---|---|---|
| 3,911,875 | A | * | 10/1975 | Ysberg | 123/41.34 |
| 4,044,737 | A | * | 8/1977 | Nishimura | 123/568.29 |
| 4,106,449 | A | * | 8/1978 | Matsumoto et al. | 123/568.12 |
| 5,052,363 | A | * | 10/1991 | Stiles | 123/568.29 |
| 5,912,520 | A | * | 6/1999 | Kobayashi et al. | 310/80 |
| 2006/0032485 | A1 | | 2/2006 | Wilson et al. | |

FOREIGN PATENT DOCUMENTS

| | | | |
|---|---|---|---|
| JP | 6-173784 | A | 6/1994 |
| JP | 10-231752 | A | 9/1998 |
| JP | 2002-4953 | A | 1/2002 |
| JP | 2003-184659 | A | 7/2003 |
| JP | 2004-100568 | A | 4/2004 |
| JP | 2006-112419 | A | 4/2006 |

* cited by examiner

*Primary Examiner* — Mahmoud Gimie
(74) *Attorney, Agent, or Firm* — Birch, Stewart, Kolasch & Birch, LLP

(57) ABSTRACT

An inner surface of an exhaust gas passage 22 of an EGR valve 11 is coated with Teflon coating 31 and a surface of a valve rod 25 is coated with a film 32 of chromium plating.

2 Claims, 2 Drawing Sheets

EXHAUST GAS RECIRCULATION VALVE

TECHNICAL FIELD

The present invention relates to an exhaust gas recirculation valve provided in a recirculation passage of the exhaust gas of an engine.

BACKGROUND ART

In order to reduce NOx in the exhaust gas of an engine of an automobile vehicle, an engine is provided with an exhaust gas recirculation system recirculating the exhaust gas to an intake side. An exhaust gas recirculation passage thereof is provided with an EGR valve ("Exhaust Gas Recirculation" valve), and an EGR valve is controlled based on driving information or the like of an engine. If high-temperature exhaust gas is recirculated to an intake side as it is, the efficiency of an engine becomes deteriorated. Thus, in general, an exhaust gas recirculation passage is provided with an EGR cooler for cooling high-temperature exhaust gas. An EGR cooler is disclosed in Patent Document 1, for example.

Patent Document 1: JP-A-2003-184659

Exhaust gas of an engine contains sulfur oxides coming from a fuel system, and nitrate oxides and particulate matter (PM) such as soot and the like which are produced by combustion. Sulfur oxides and nitric acid compounds produce corroding matter containing sulfuric acid and nitric acid in an exhaust gas passage. When such corroding matter enters an EGR valve, the matter corrodes a portion of a valve mechanism exposed to exhaust gas passing through an exhaust passage of the EGR valve and the inner surface of the exhaust gas passage of the valve body. The tendency is accelerated by the temperature of an exhaust gas being reduced by an EGR cooler.

An exhaust gas passage of an EGR valve is made of material such as cast iron or aluminum alloys, and thus corroding matter produced in an exhaust gas passage corrodes the inner surface of the exhaust gas passage, and produces corroded products such as rust and the like. Such corroded products can flake off by the flow of circulating exhaust gas and the vibration or the like of an engine. Meanwhile, a valve head (valve disk) of an EGR valve is made of material such as stainless steel or the equivalent that resists corrosion; however, the corroding matter corrodes a portion of the surface of the valve head extremely near to the superficial layer of the surface thereof and the surface thereof is put into a rough state. Corroded products flaked off from the corroded inner surface of an exhaust gas passage, the soot contained in exhaust gas, or the like come to easily adhere to such an surface of the valve head. Those corroded products, soot, and the like also adhere to the vicinity of a bearing section of a valve rod, and become a cause of interfering with an operation between the valve rod and the bearing.

The present invention is made in view of such a technical situation, and an object of the present invention is to reduce the tendencies of an exhaust gas passage and a valve rod of an EGR valve provided in an exhaust gas recirculation passage to be adhered to by corroded products, soot and the like.

DISCLOSURE OF THE INVENTION

The EGR valve according to the present invention is characterized in that film of corrosion-resisting material is formed over at least a portion of the inner surface of an exhaust gas passage, and a film of a corrosion-resisting material is formed over at least a portion of the surface of a valve rod which is exposed to exhaust gas.

According to the EGR valve according to the present invention, the film of the corrosion resisting material is formed over the inner surface of an exhaust gas passage, thus reducing the tendencies of corroded products to adhere to the inner surface thereof and enabling the prevention of corrosion of the inner surface of the exhaust gas passage. Further, since the film of the corrosion resisting material is formed over the surface of a valve rod, the tendencies of corroded products to adhere to the surface of the valve rod is reduced and the malfunction of the valve rod can be prevented.

BEST MODE FOR CARRYING OUT THE INVENTION

Embodiments of the present invention will now be described with reference to the accompanying drawings in order to explain the present invention in more detail.

First Embodiment

Figure 1:
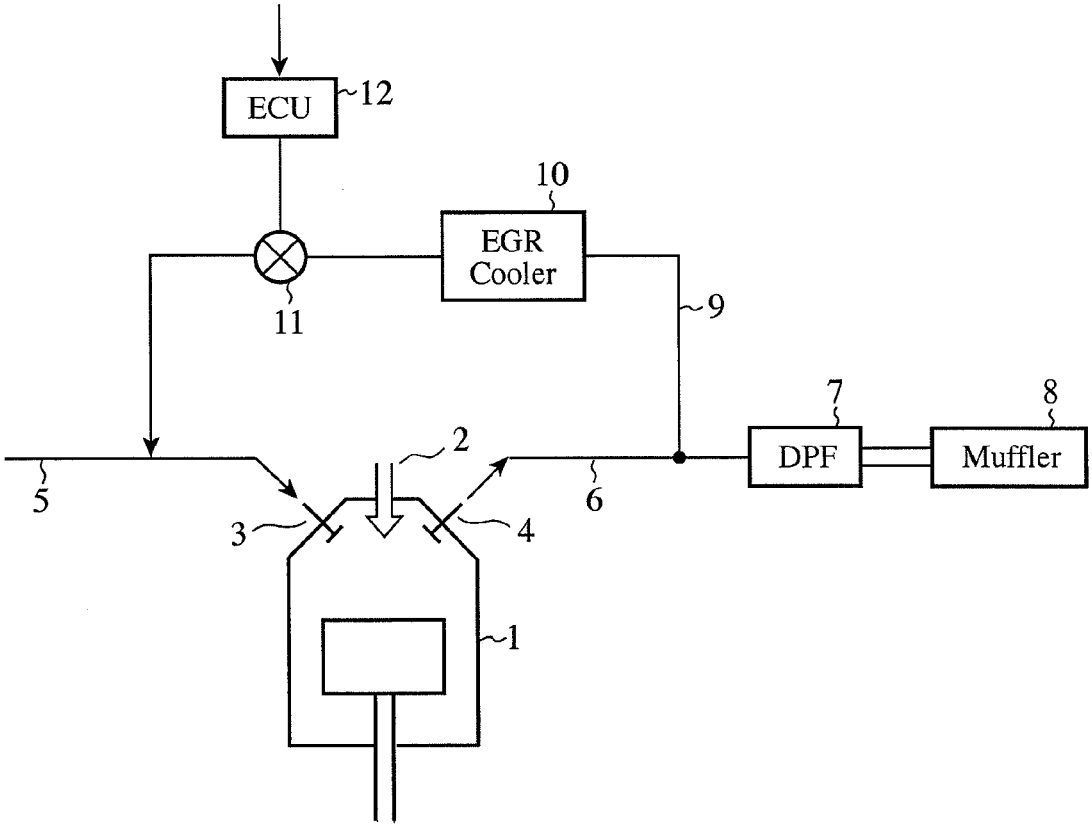
FIG. 1 is a schematic view of an engine equipped with an EGR valve to which the present invention is applied.
Figure 2:
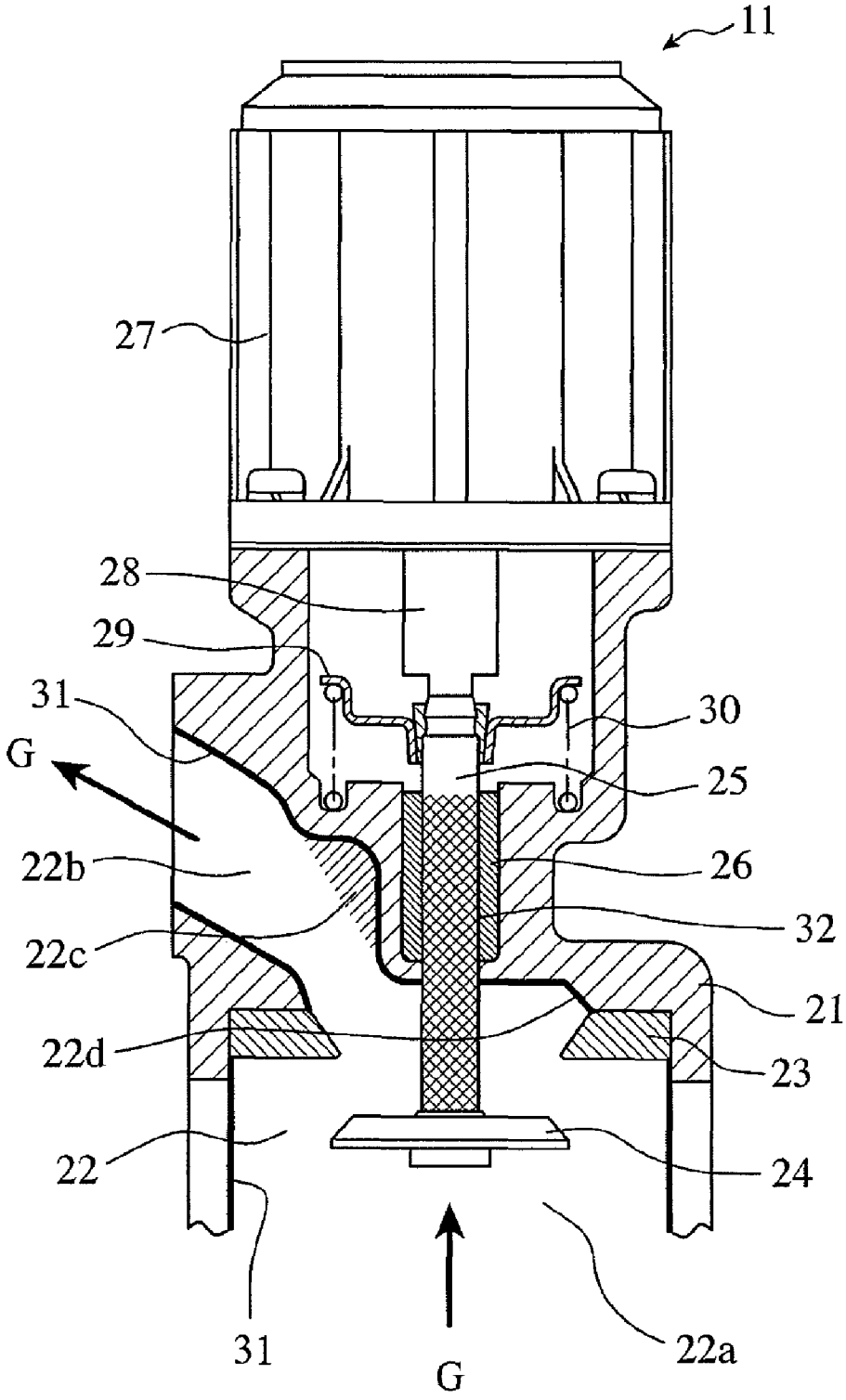
FIG. 2 is a sectional view of an EGR valve according to the first embodiment of the present invention.

FIG. 1 is a schematic view of an engine equipped with an EGR valve and an EGR cooler, and FIG. 2 is a sectional view of an EGR valve according to the first embodiment of the present invention.

First, the outline of an engine as an object of the present invention is concerned will be discussed. A fuel injection nozzle 2 is faced to the combustion chamber of a diesel engine 1, and the combustion chamber is provided with an inlet valve 3 taking in air to the combustion chamber and an exhaust valve 4 exhausting combustion gas in the combustion chamber therefrom. The inlet valve 3 has an intake passage 5 connected thereto and the exhaust valve 4 has an exhaust passage 6 connected therewith. The exhaust passage 6 is sometimes provided with a DPF filter 7 for removing particulate matter (PM) existing in an exhaust gas, and further is provided with a muffler 8. The exhaust passage is provided with an exhaust gas recirculation passage 9 that is branched from the exhaust passage 6 and connected with the intake side thereof, and the exhaust gas recirculation passage 9 is provided with an EGR cooler 10 and an EGR valve 11. The EGR cooler 10 has a structure for cooling an exhaust gas by a water cooling system. The EGR valve 11 is controlled by an electronic control unit (ECU) 12. The EGR valve 11 controls the exhaust gas cooled by the EGR cooler 10 based on a variety of information such that an optimum amount of the exhaust gas is supplied to the intake side thereof.

As shown in FIG. 2, with respect to the EGR valve 11, a valve housing 21 forming a main body thereof is provided with an exhaust gas passage 22 for introducing the exhaust gas cooled by the EGR cooler 10 to the intake side; the exhaust gas passage 22 is provided with a valve seat 23 formed at the halfway position of the passage; and the exhaust gas passage is further provided with a valve head (valve disk) 24 opening and closing the exhaust gas passage 22 by engaging and disengaging the valve seat 23. The valve head 24 is provided on the tip of a valve rod 25 by force-fitting the valve rod thereinto or the like. The valve rod 25 is axially slidably supported by a bearing 26 assembled in the valve housing 21.

The rear end of the valve rod 25 is opposed to the tip of a rod 28 of an actuator 27 provided on the valve housing 21. The actuator 27 is driven and controlled by a command from the electronic control unit (see FIG. 1) . The valve rod 25 has a spring holder 29 attached on the upper portion thereof, and provided between the spring holder 29 and the valve housing 21 is a spring 30 exerting a spring force on the valve rod 25 and causing the valve head 24 to engage the valve seat 23. The actuator 27 is operated by the electronic control unit to thereby cause the rod 28 to axially press the valve rod 25, and thereby, the valve head 24 is separated from the valve seat 23, thus opening the valve. The rod 28 of the actuator 27 returns by a restoring force of the spring 30, thus engaging the valve head 24 to the valve seat 23.

The exhaust gas passage 22 is composed of an intake side exhaust gas passage 22*a* and an exhaust side exhaust gas passage 22*b* with the valve seat 23 forming a division. A film 31 of a corrosion-resisting material (exhaust-gas-passage-inner-surface film) is formed over the inner surfaces of those exhaust gas passages 22*a*, 22*b*. Further, a film 32 of a corrosion-resisting material (valve-rod film) is formed over the surface of the valve rod 25 made of stainless steel or the like. The exhaust-gas-passage-inner-surface film 31 is made of Teflon coating film or ceramic coating film, and Teflon coating film is employed in the embodiment. The valve-rod film 32 is made of a plating film of nickel, titanium, chromium, a nickel alloy, a titanium alloy, or a chromium alloy, and to be more exact, the valve-rod film is made of an electroless nickel plating film, a titanium-nickel plating film, a chromium plating film, and a hard chromium plating film. In the embodiment, the chromium plating film is employed.

When the exhaust-gas-passage-inner-surface film 31 made of Teflon coating or the like is provided on the inner surfaces of the intake side exhaust gas passage 22*a* and the exhaust side exhaust gas passage 22*b*, the tendencies of these inner surfaces to be corroded by corroding matters produced by circulating exhaust gas G from an engine are reduced, and thereby the tendencies of corroded products to be produced are reduced. The exhaust gas passage 22 of the valve housing 21 has a complicated structure, and thus the flow of the circulating exhaust gas G circulating through the passage is not uniform at each position on the exhaust gas passage 22. For example, the corrosion of the inner surface of the exhaust gas passage 22*a* caused by the corroding matter fast advances, e.g., in a portion thereof where a stream of the circulating exhaust gas G is bent and thereby the flow of the circulating exhaust gas G is fast, and more corroded products also tend to be produced in the corresponding portion. For this reason, it is also effective to coat only such portions thereof with the exhaust-gas-passage-inner-surface film 31, and further, when the entire inner surface of the exhaust gas passage 22 is coated with the exhaust-gas-passage-inner-surface film 31, it is also effective to increase the thickness of the film formed over the surfaces of those portions.

When the exhaust gas passage 22*b* has a complicated structure, the exhaust gas passage has portions such as a recess 22*c* formed in the exhaust gas passage 22*b* and a portion 22*d* hidden behind component parts, where the flow of circulating exhaust gas is extremely slow. Soot or the like circulating together with the exhaust gas is apt to be deposited on those portions 22*c*, 22*d*. The exhaust-gas-passage-inner-surface film 31 is also effective for boosting the tendency of such deposited soot or the like to flake off from the exhaust gas passage 22.

The surface of the valve rod 25 is coated with the valve rod film 32, thus preventing a roughed state on the surface of the valve rod 25, and reducing the tendencies of corroded products, soot, or the like to adhere thereto. The film 32 has only to be formed over at least a portion of the valve rod 25 which projects from the bearing 26 when the valve is opened. However, it is easier to form the film 32 such as plating over the entire surface of the valve rod 25 rather than to form the film over a partial portion thereof, and thus, in the embodiment, the entire surface of the valve rod is coated with chromium plating.

According to the EGR valve according to the embodiment, the tendencies of corroded products, soot, and the like contained in exhaust gas to adhere to the inner surface of the exhaust gas passage 22 are reduced; the adherent can be easily removed therefrom even if adhered thereto by forming the film 31 such as Teflon coating, ceramic coating, or the like over the exhaust gas passage 22. Further, the surface of the valve rod 25 is prevented from being roughed by corroded products contained in the exhaust gas, and further the tendencies of corroded products, soot, and the like to adhere to the surface of the valve rod 25 are relieved by forming the film 32 such as electroless plating film of nickel, plating film of an alloy of titanium and nickel, and chromium, and hard plating film of chromium, over the valve rod 25. Therefore, those products, soot, and the like do not cause trouble in sliding of the valve rod 25 along the bearing 26.

INDUSTRIAL APPLICABILITY

As mentioned above, the exhaust gas recirculation valve according to the present invention is capable of preventing the corrosion of the inner surface of the exhaust gas passage and in the same instance preventing the malfunction of the valve rod, by forming a film of a corrosion-resisting material over at least a portion of the inner surface of the exhaust gas passage and forming a film of a corrosion-resisting material over at least a portion of the surface of a valve rod, which is exposed to exhaust gas; thus the exhaust gas recirculation valve is suitable for use, for example, in exhaust gas recirculation valves provided in a recirculation passage of the exhaust gas of an engine.

The invention claimed is:

1. An exhaust gas recirculation valve which is an exhaust gas recirculation valve provided in an exhaust gas recirculation passage for recirculating the exhaust gas of an engine, wherein a film of Teflon or ceramic is formed over at least a portion of the inner surface of an exhaust gas passage and a plating film of nickel, titanium, chromium, a nickel alloy, a titanium alloy, or a chromium alloy is formed over at least a portion of the surface of a valve rod which is exposed to exhaust gas.

2. The EGR valve according to claim 1, wherein the portion of the exhaust gas passage over which the film is formed includes at least a recess provided on the inner surface of the exhaust gas passage or a portion of the exhaust gas passage which is exposed to exhaust gas.

* * * * *